US005653673A

United States Patent [19]

Desai et al.

[11] Patent Number: 5,653,673

[45] Date of Patent: Aug. 5, 1997

[54] WASH CONDUIT CONFIGURATION IN A CENTRIFUGE APPARATUS AND USES THEREOF

[75] Inventors: Vikram J. Desai, Naperville, Ill.; John W. Caldwell, Glenside, Pa.; Alan G. Letki, Mt. Laurel, N.J.

[73] Assignee: Amoco Corporation, Chicago, Ill.

[21] Appl. No.: 475,044

[22] Filed: Jun. 7, 1995

Related U.S. Application Data

[63] Continuation-in-part of Ser. No. 266,240, Jun. 27, 1994, abandoned.

[51] Int. Cl.[6] ..... B04B 1/20

[52] U.S. Cl. ..... 494/27; 494/37; 494/53; 494/54

[58] Field of Search ..... 494/23, 25, 26, 494/27, 28, 29, 37, 53, 54, 85

[56] References Cited

U.S. PATENT DOCUMENTS

| | | | |
|---|---|---|---|
| 535,306 | 3/1895 | Stewart . | |
| 581,354 | 4/1897 | Lapp . | |
| 832,191 | 10/1906 | Holzer . | |
| 1,614,357 | 1/1927 | Gamper . | |
| 1,756,194 | 4/1930 | Haug . | |
| 2,184,598 | 12/1939 | Jahn | 494/27 |
| 2,435,623 | 2/1948 | Forsberg . | |
| 2,578,456 | 12/1951 | Smith . | |
| 2,612,314 | 9/1952 | Huelsdonk . | |
| 2,743,864 | 5/1956 | Lyons . | |
| 2,862,658 | 12/1958 | Dahlgren . | |
| 2,905,379 | 9/1959 | Sticker | 494/27 X |
| 3,228,594 | 1/1966 | Amero . | |
| 3,279,687 | 10/1966 | Amero . | |
| 3,302,873 | 2/1967 | Kowata . | |
| 3,326,457 | 6/1967 | McMorris, Jr. . | |
| 3,348,767 | 10/1967 | Ferney . | |
| 3,423,015 | 1/1969 | O'Conor . | |

(List continued on next page.)

FOREIGN PATENT DOCUMENTS

| | | | |
|---|---|---|---|
| 1152315 | 2/1958 | France | 494/54 |
| 1021297 | 12/1957 | Germany | 494/27 |
| 1782428 | 9/1971 | Germany . | |
| 4119003 | 12/1992 | Germany | 494/53 |
| 347084 | 8/1972 | U.S.S.R. | 494/54 |
| 797777 | 1/1981 | U.S.S.R. | 494/54 |

OTHER PUBLICATIONS

Drawing No. E–620 of a P–14 centrifuge (Alfa Laval), Apr. 13, 1946.

Drawing No. E–759 of a P–14 centrifuge (Alfa Laval), Apr. 16, 1947.

*Primary Examiner*—Charles E. Cooley

*Attorney, Agent, or Firm*—Frederick S. Jerome; Thomas E. Nemo; Wallace L. Oliver

[57] ABSTRACT

Centrifugal apparatus for the continuous separation of solids-liquid mixtures and the internal washing of separated solids is provided with one or more conduits to deliver washing liquid into centrifugally sedimented solids tumbling and suspending these solids in washing liquid. A distal end of each wash conduit is positioned in close proximity to the inner surface of the centrifuge bowl near the conveyor blade which is adapted to contact the solids upon separation and propel separated solids toward the solids discharge port. The invention includes centrifugal apparatus provided with plurality of cutting tools such as knife blades adapted to cut and separate the sedimented solids. In another aspect of the invention centrifugal apparatus is provided with one or more dip weirs dividing the centrifugally separated liquid pool in the bowl into axially adjacent zones with suitable a passageway for transfer of liquids and solids between adjacent zones. In another aspect of the invention at least a portion of the leading surface of the conveyor blade is provided with an arcuate surface portion adjacent to the distal edge thereof of defined concavity in the leading surface and shape adapted to contact the sedimented solids and tumbling them in washing liquid. This invention provides improved separation of mother liquor from discharged solids and/or reduction of washing liquid required to achieve desired purity of recovered solid product.

25 Claims, 4 Drawing Sheets

U.S. PATENT DOCUMENTS

| | | | |
|---|---|---|---|
| 3,447,742 | 6/1969 | Erikkson et al. . | |
| 3,471,081 | 10/1969 | O'Conor | 494/27 |
| 3,764,062 | 10/1973 | Brautigam . | |
| 3,795,361 | 3/1974 | Lee . | |
| 3,934,792 | 1/1976 | High et al. . | |
| 3,971,509 | 7/1976 | Johnson . | |
| 4,190,194 | 2/1980 | Amero . | |
| 4,298,159 | 11/1981 | Epper et al. | 494/53 X |
| 4,299,352 | 11/1981 | Erickson et al. . | |
| 4,313,559 | 2/1982 | Ostkamp et al. . | |
| 4,328,925 | 5/1982 | Shapiro . | |
| 4,449,967 | 5/1984 | Caldwell . | |
| 4,496,340 | 1/1985 | Redeker et al. . | |
| 4,589,866 | 5/1986 | Stahl | 494/54 |
| 4,617,010 | 10/1986 | Epper et al. . | |
| 4,654,022 | 3/1987 | Shapiro . | |
| 4,731,182 | 3/1988 | High . | |
| 4,826,608 | 5/1989 | Kopper . | |
| 5,176,616 | 1/1993 | Schlip et al. | 494/25 X |
| 5,182,020 | 1/1993 | Grimwood . | |
| 5,261,869 | 11/1993 | Caldwell et al. . | |
| 5,306,225 | 4/1994 | Miyano et al. | 494/53 |

WASH CONDUIT CONFIGURATION IN A CENTRIFUGE APPARATUS AND USES THEREOF

CROSS-REFERENCE TO RELATED APPLICATION

This application is a continuation-in-part of now abandoned application Ser. No. 08/266,240 filed Jun. 27, 1994, which is specifically incorporated herein in its entirety by reference.

TECHNICAL FIELD

This invention relates to screw conveyor centrifugal apparatus for separation of solids-liquid mixtures and internal washing of solids. More particularly, the conveyor is provided with one or more wash conduits to deliver washing liquids into centrifugally sedimented solids within a portion of the bowl positioned along its axis at locations between the solids-liquid feed and the discharge of solids therefrom. The distal end of each independent wash tube is positioned in close proximity to the inner surface of the bowl near the distal edge of the conveyor blade or blades which are adapted to contact the solids upon separation and propel separated solids toward the solids discharge port. In another aspect of this invention, the conveyor is, advantageously, provided with one or more cutting tools, such as knife blades, adapted to cut and separate the sedimented solids in cooperation with the helical conveyor blade. Knives and/or wash conduits, in use, deliver washing liquid into sedimented solids, tumbling and suspending them in washing liquid. In another aspect of the invention the conveyor is provided with one or more dip weirs dividing the centrifugally separated liquid pool in the bowl into axially adjacent zones, each dip weir having an outer edge spaced from the inner bowl surface to provide a suitable passageway for transfer of liquids and solids between adjacent zones. In another aspect of the invention, a leading surface of at least a portion of one conveyor blade is provided with an arcuate surface portion adjacent to the distal edge thereof of defined concavity in the leading surface and shape adapted to contact the sedimented solids and tumbling them in washing liquid. Interaction among elements of this invention provide improved separation of mother liquor from discharged solids and/or reduction of washing liquid required to achieve desired purity of recovered solid product.

Another aspect of the invention includes processes which use such improved centrifuge apparatus for continuous separation of solids-liquid mixtures into separate components by centrifugal action. This invention provides, for example, improved separation of mother liquor from discharged solids and/or reduction of washing liquid required to achieve desired purity of recovered solid product.

BACKGROUND OF THE INVENTION

Solid-bowl centrifuge decanters are well known. Typically such apparatus comprises an elongated bowl mounted for rotation about its longitudinal axis with a helical screw conveyor, coaxially mounted within the bowl, adapted to rotate at a speed slightly different than the speed of rotation of the bowl; the bowl is tapered or trunco-conical near its solids discharge end. The screw conveyor is formed of one or more helically arrange blades, which sweep the surface of the bowl of the apparatus while propelling the centrifugally separated solids toward the solids discharge port. An example of such equipment in which the blade is helically mounted on a hub is described in U.S. Pat. No. 3,764,062, the disclosure of which is incorporated herein by reference.

In operation of a solid-bowl centrifuge decanter with a screw conveyor, a solids-liquid feed is introduced into the bowl, where, due to centrifugal force effected by rotation of the bowl, the feed separates into its component parts with the heavier part, typically solids, being moved outboard of the other feed components in a pool of liquid, and adjacent to the inner surface of the bowl. Since the bowl and screw conveyor are rotated at predetermined different speeds, solids sedimented against the inner surface of the bowl are conveyed by the distal edge of the conveyor's blade along the bowl surface until separated from the pool of liquid and discharged from one or more ports at the tapered end of the bowl.

Commercially important uses of solid-bowl centrifuge decanters include separation of solid crystalline chemical compounds from liquids under process conditions which do not degrade quality, such as chemical purity of a desired crystalline product. Crystallization, as a commercial process, is significant because of the great variety of materials that are marketed in the crystalline form. Its wide use is due basically to the fact that a crystal forming from an impure solution is, generally, itself pure. Thus, crystallization affords a practical method of obtaining concentrated chemical substances in a form both pure and attractive and in suitable condition for packaging, handling, and storing.

Although a crystal itself is necessarily pure, it retains mother liquor when removed from the final solids-liquid mixture or magma, and the adhering mother liquor will carry its share of the impurities present in the mother liquor. If the retained mother liquor is dried on the crystal, product contamination results. In practice, centrifuging leaves mother liquor mounting as much as 50 percent of the weight of the crystals. Large uniform crystals from low-viscosity mother liquors will retain a minimum proportion of mother liquor, while non-uniform small crystals from viscous solutions will retain a considerably larger proportion.

Residual impurities in the centrifuge cake can be reduced by admixing a diluent liquid or solvent liquid with the solids-liquid centrifuge feed. Such diluent liquid lowers concentration of impurities in the mother liquor and consequently reduces the amount of residual impurities in the centrifuge cake even without a reduction in the amount of mother liquor retained. This method is highly inefficient and, particularly where compounds are crystallized from an organic solvent, it has additional capital and operating costs, because it requires using a very large amount of diluent per unit of solid product to achieve a significant reduction of residual impurities.

It is common practice to wash the crystals with fresh solvent on the centrifuge or in an additional slurry/separation unit. In principle such washing can reduce impurities to below almost any arbitrary level, but these methods are not usually so satisfactory as expected and may also have significant additional capital and operating costs.

For example, an evaluation of a continuous solid bowl centrifuge for processing simulated Rover dissolver effluent by J. S. Vavruska and J. A. Rindfleisch is described in Nucl. Sci. Abstr. 1975, 32(10), Abstr. No. 24218 (1975). A plant-scale continuous solid bowl centrifuge was used as a method of solids-liquid separation and solids washing. The solid bowl centrifuge reduced undissolved solids content of the liquid effluent of the Rover dissolver under conditions studied. Although wash injection nozzles were located within the centrifuge bowl, it is reported that little or no washing of occluded uranium from the solids was possible. The most effective removal of occluded uranium resulted from repulping undissolved solids in water in two or more stages and recycling the repulped slurry through the test centrifuge.

U.S. Pat. No. 3,971,509 to Frank Birger Johnsen describes a centrifuge comprising an outer drum and an inner rotor which carries at least two screw helixes for transporting solid matter axially towards discharge ports. An aperture is provided in each helix at its distal edge or outer periphery whereby patentee states that the axial movement of at least some of the transported solid matter is temporarily stopped when that matter passes through the aperture. A washing liquid is supplied through openings or spray nozzles in the rotor shortly upstream of each aperture. It is stated that a spray of washing liquid from the rotor can act upon the solid matter during the period in which its axial movement may be interrupted. When the screw is provided with an aperture in each of its helices, the interior of the rotor may be divided into at least two axially spaced chambers and a separate washing liquid used in connection with each chamber. Patentee states that it is possible to effect control of static pressure which acts upon the washing liquid in each of the chambers and determines the outflow velocity of the liquid spray from the chamber.

In washing cake on a conventional centrifuge, washing liquid flows over or is sprayed on top of sedimented cake near the point along the axis of the centrifuge where the cake is conveyed out of the liquid pool in a "beach" section of the centrifuge. For example, see U.S. Pat. No. 3,302,873 to Yasuo Kowata, U.S. Pat. No. 4,496,340 to Detmar Redeker and Dieter Mrotzek, or U.S. Pat. No. 4,654,022 to Leonard Shapiro. Spray washing in a conventional centrifuge is, however, not as effective as required because much of the washing liquid flows over the surface of the cake and into the liquid pool of mother liquor thus leaving the centrifuge without penetrating the bulk of the cake to displace mother liquor retained within the cake except on or near the surface of the cake.

U.S. Pat. No. 4,654,022 to Leonard Shapiro describes a centrifuge fabricated with a hollow flight member at the bowl dry beach area by welding sheet metal to trailing surfaces of the flight. Leading or working surface of the flight is provided with a plurality of series of orifices per 360° revolution thereof, each series comprising spaced small orifices, typically 0.030 to 0.125 inches in diameter, spiraling inwardly from the outer edge of the flight and ending with large overflow orifices in the flight near its edge attached to the conveyor hub. In operation, rinse liquid is said to pass onto solids pile surfaces through orifices immediately inwardly of the pile surface. It is also stated that it is possible for small amounts of rinse liquid to pass through orifices submerged by the wedge of solids formed against flight adjacent to the bowl wall. Since the density of the solids pile becomes progressively greater as the bowl wall is approached in the dry beach area, Shapiro speculates that in this apparatus the amount of rinse liquid urged out of the submerged orifices is proportionately decreased as the orifices are disposed more outwardly in the flight. Most of the washing liquid is believed to flow over the surface of the cake and into the liquid pool thus diluting the mother liquor, but leaving the centrifuge without penetrating the bulk of the cake to displace mother liquor retained within the cake.

There remains, therefore, a current need for centrifugal apparatus which provides means for more effective washing of crystals with fresh solvent on the centrifuge. Advantageously, such means for washing of crystals in a centrifuge would require only a limited amount of washing liquid to penetrate a sedimented cake and effectively displace mother liquor from within the cake.

SUMMARY OF THE INVENTION

In broad aspect, the invention is that in screw conveyor centrifugal apparatus for the continuous separation of solids-liquid mixtures and the internal washing of solids, the conveyor is provided with one or more conduits to conduct washing liquids outward from the conveyor hub into sedimented solids at least within the trunco-conical portion of the bowl. The distal end of the wash conduit is, advantageously, positioned in close proximity to the distal edge of the conveyor blade which is adapted to contact the solids upon separation and propel separated solids toward the solids discharge port. The wash conduit, in use, directs washing liquid from its distal end into sedimented solids, tumbling and suspending them in washing liquid.

in another aspect, the invention is that in screw conveyor centrifugal apparatus for the continuous separation of solids-liquid mixtures and the internal washing of solids, the conveyor is provided with one or more cutting tools or knife blades. These tools are adapted to groove, channel, cut or separate centrifugally sedimented solids in cooperation with the helical conveyor blade. Solids-cutting tools may be curved vanes or they may be planar vanes disposed near the distal edge of the conveyor blade which is adapted to contact the solids upon separation and propel separated solids toward the solids discharge port. In operation, typically, a plurality of solids-cutting knife blades groove, channel, cut and separate the sedimented solids, preferable at least within the trunco-conical portion of the bowl.

In another aspect, the invention is that in screw conveyor centrifugal apparatus for the continuous separation of solids-liquid mixtures and the internal washing of solids, the conveying means within the bowl is provided with one or more dip weirs with broad surfaces dividing the helical chamber, defined by the inner bowl surface and the conveyor blade and extending between opposite ends of the bowl, into axially adjacent zones including at least a first zone in the helical chamber which extends in axial direction from one broad surface of a dip weir to the solids discharge port and a last zone in the helical chamber which extends in axial direction from the opposite broad surface of the same or another dip weir to the liquid overflow ports, each dip weir having an outer edge spaced from the inner bowl surface to provide a suitable passageway for transfer of liquids and solids between adjacent zones.

In yet another aspect, the invention is that in screw conveyor centrifugal apparatus for the continuous separation of solids-liquid mixtures and the internal washing of solids, one or more leading surface of at least a portion of one conveyor blade within the bowl is provided with an arcuate surface portion adjacent to the distal edge thereof of defined concavity in the leading surface and shape adapted to contact the centrifugally sedimented solids and tumbling them in washing liquid In other aspects, the invention includes processes using these improved centrifuges for the continuous separation of solids-liquid mixtures and the internal washing of solids. For example, where one or more impurities are contained in a mother liquor, this invention provides processes for improved separation of mother liquor from discharged solids and/or reduction of washing liquid required to achieve desired purity of recovered solid product.

BRIEF DESCRIPTION OF THE DRAWINGS

The appended claims set forth those novel features which characterize the present invention. The present invention itself, as well as advantages thereof, may best be understood, however, by reference to the following brief description of preferred embodiments taken in conjunction with the annexed drawings, in which:

BRIEF DESCRIPTION OF THE INVENTION

Figure 1:
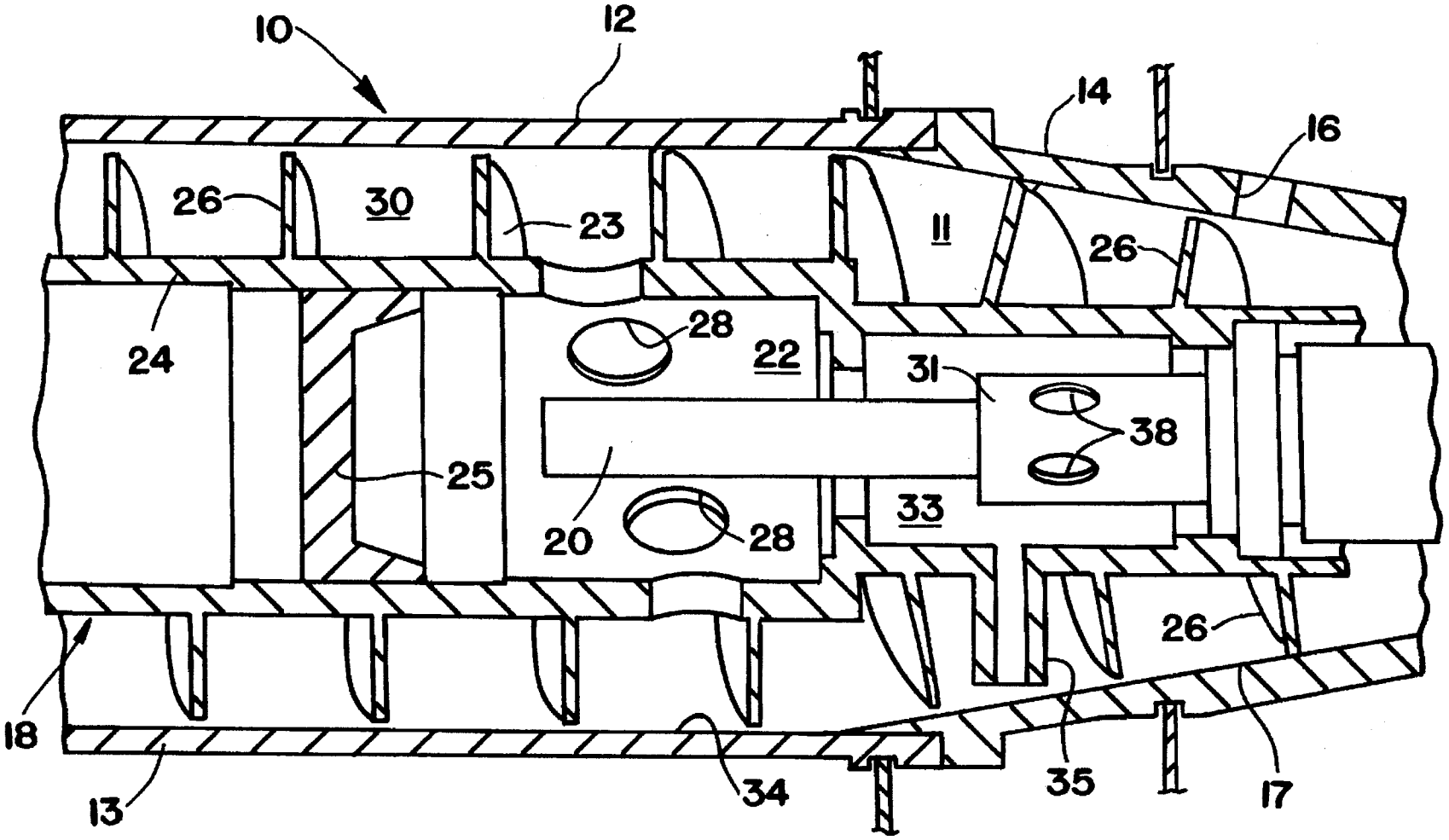
FIG. 1 is a fragmentary, longitudinal sectional view of a centrifuge, taken through the rotational axis of the centrifuge, embodying a wash conduit configuration of the present invention.

In operation of a solid-bowl centrifuge decanter with a screw conveyor, a solids-liquid feed is introduced into the bowl, where, due to centrifugal force effected by rotation of the bowl, heavier and lighter components of the feed slurry separate. The heavier solids move outboard in a pool of the lighter liquid phase forming a layer of sedimented solids adjacent to the bowl's inner surface. Since the bowl and screw conveyor are rotated at different speeds, typically controlled by a predetermined conveyor gear ratio, solids sedimented against the inner surface of the bowl are conveyed by the conveyor's blade along an annular space inside of the bowl's inner surface toward the trunco-conical end of the bowl where the sedimented solids are conveyed out of the liquid pool and discharged from one or more ports at the trunco-conical end of the bowl. Liquid for internal washing of the solids cake is, generally, introduced into the bowl within the trunco-conical portion of the bowl to displace mother liquor from the solids prior to their discharge.

The present invention provides a means for supplying washing liquid directly into sedimented solids at least within the trunco-conical portion of the bowl. According to the present invention, a conveyor is provided with one or more conduits to conduct washing liquid outward from the conveyor hub with the distal end of each wash conduit positioned in close proximity to the distal edge of the conveyor blade, preferably near the drying beach in the trunco-conical portion of the bowl where the sedimented solids are conveyed out of the liquid pool. The wash conduit, in use, directs washing liquid into the cake of centrifugally sedimented solids, tumbling and suspending them in washing liquid. Flow of washing liquid is, advantageously, adjusted to have a local velocity sufficient to fluidize the solid particles in a region around the distal end of the wash conduit, thus making intimate contact with each fluidized solid particles, diluting and/or displacing mother liquor from the cake when the solids resettle and liquid drains from the slush into the pool.

The distal end of each wash conduit is, advantageously, adapted to direct the flow of washing liquid in any desired direction depending on the design of bowl, conveyor hub and/or flights, the nature of the solids in the cake, and the preselected washing liquid. In some cases, washing may be further enhanced by use of knives, vanes, prongs, and/or dip weirs which can be installed on the conveyor hub.

Knives, vanes, prongs, and like means according to this invention are, advantageously, positioned to cut through the cake to the bottom of the sedimented solids adjacent to the bowl's inner surface, thus stirring-up, mixing, and dispersing the solid particles in the washing liquid. Suitable solids-cutting knife blades are thin, narrow vanes which may be curved vanes or they may be planar vanes disposed either radially or at an acute angle relative to a radius from the longitudinal axis of the centrifuge. In operation, one or more knife blades cut and separate the sedimented solids, preferable at least within the trunco-conical portion of the bowl.

In one embodiment of the present invention, a centrifuge apparatus for continuous separation of solids-liquid mixtures into separate components by centrifugal action comprising an elongated bowl having an inner bowl surface including a cylindrical portion adapted to receive the solids-liquid mixtures and a trunco-conical portion having a discharge port adapted to discharge of solids separated from the mixture, the bowl being mounted for rotation about its longitudinal axis, and a conveying means including at least one conveyor blade having a leading surface facing in the direction of the port and a distal edge, the conveyor blade being helically and coaxially mounted within the bowl through the length of the bowl surface with the distal edge of the conveyor blade in a closely spaced, sweeping relationship to the bowl surface and means for rotating the bowl and the conveyor blade at a speed differential to contact the distal edge of the conveyor blade with the solids upon separation and propel separated solids toward the solids discharge port, the improvement which comprises providing the conveying means with one or more knife blades adapted to cut and separate the sedimented solids in cooperation with the helical conveyor blade at least within the trunco-conical portion of the bowl.

These solids-cutting knife blades may be curved vanes or they may be planar vanes, preferably having "V" shaped cutting edges, and more preferably a diamond-shaped transverse cross-section. Knife blades are disposed according the invention between flights near the distal edge of the conveyor blade which are adapted to contact the solids upon separation and propel separated solids toward the solids discharge port. In operation, knife blades cut a swath in the sedimented solids on the inner surface of the bowl. Preferably a plurality of knife blades is disposed around the conveyor hub within the trunco-conical portion of the bowl, more preferably near a point along its axis where cake was conveyed out of the liquid pool and onto the drying beach.

Referring to FIG. 1, centrifuge apparatus 10 comprises an axially elongated, imperforate bowl 12 of annular cross-section which receives the solids-liquid mixture. Bowl 12 is adapted for rotation about a longitudinal axis. In addition to a main portion 13 of generally cylindrical shape, bowl 12 includes a tapered or convergent end portion 14 of generally trunco-conical form. The inner surface 34 of end portion 14 of bowl 12 gradually decreases in diameter towards a solids discharge port 16, the inner surface 34 of the bowl thus providing a drying "beach" 17 for solids moving toward port 16 and out of the liquid pool, or pond (not shown) created by the centrifugal action when apparatus 10 is in use.

Coaxially mounted within bowl 12 is a helical screw conveyor 18, comprising hub 24 on which are mounted a blade 26 and a wash tube 35. The blade is helically formed, and has a plurality of turns or flights, for example flights 26A, 26A' and 26A" in embodiment of FIG. 2. Conveyor 18 is rotatably mounted on a common axis with bowl 12 and is adapted to be driven at a speed slightly different from that of bowl 12, as a result of the speed differential solids are conveyed in axial direction by contact with the leading surface of blade 26. Generally, in operation the differential speed of the conveyor with respect to the bowl is preselected. The relative speed of the conveyor is, however, sometimes a variable and can be controlled. Wash tube 35 projects outward from hub 24 toward the inner surface 34 of bowl 12 at any position along their common axis between feed chamber 22 and solids discharge port 16. Wash tubes are, advantageously, positioned between and, at least near their distal ends, separate from the flights.

The solids-liquid mixture is delivered as feed to the interior of centrifuge 10 through a stationary feed tube 20. Tube 20 projects in an axial direction and terminates concentrically of a feed chamber 22 defined by the interior of hub 24 and target disc 25. Feed introduced into feed chamber 22 exits radially therefrom through feed passages 28 into separation chamber 30 disposed between the outer surface of hub 24 and the inner surface of bowl 12. Effluent is discharged through liquid discharge openings (not shown).

The outwardly projecting, helically formed blade 26 has a leading surface 23 facing in the direction of discharge port 16. The distal edge of blade 26 is shaped to conform to the inner surface 34 of bowl 12 such that, upon rotation of conveyor 18, the distal edge of blade 26 is closely spaced to inner surface 34 and in sweeping relationship thereto. In operation, that part of leading surface 23 of blade 26 that is contiguous to the most distal portion of blade 26 provides a working surface which contacts the solids separating from the feed due to the combined centrifugal force and the relative rotational movements of conveyor 18 and bowl 12.

Liquid is delivered as wash to the interior of centrifuge 10 through an annulus between stationary feed tube 20 and stationary tube 31. Tube 31 projects in an axial direction and terminates concentrically of a wash chamber 33 defined by the interior of hub 24. Wash introduced into wash chamber 33 through wash passages 38 in tube 31 exits radially therefrom through wash tube 35 into a washing zone in separation chamber 30 disposed between the outer surface of hub 24 and the inner surface of tapered or convergent end portion 14 of bowl 12. Effluent is discharged through liquid discharge ports or "pool" openings (not shown).

Generally, wash tube 35 is radially mounted on hub 24 at a position along the axis within the tapered or convergent end portion 14 of bowl 12, preferably at or near the drying beach 17 for solids moving toward port 16 and out of the liquid pool (not shown). The distal end of wash tube 35 is, optionally, shaped to conform to the inner surface 34 of bowl 12 such that, upon rotation of conveyor 18, the distal end of wash tube 35 is closely spaced to inner surface 34 and in sweeping relationship thereto. Optionally, the distal end of wash tube 35 contacts, in operation, the solids separating from the feed due to the combined centrifugal force and the relative rotational movements of conveyor 18 and bowl 12.

The shape or curve of the profile of working surface 27 may vary widely. For example, screw conveyors having a surface of defined curvature upon the leading surface of the helical conveyor blade or blades adjacent the distal edge thereof, are the subject of U.S. Pat. No. 4,449,967 in the name of John W. Caldwell, which patent is specifically incorporated herein in its entirety by reference. While a simple curvilinear shape is adequate, other shapes such as horse-shoe, lancet, ogee, basket-handle or the like (as these terms are used to describe an arch) are also useful. A particularly useful shape and disposition of the curvature is readily apparent in FIG. 2.

Figure 2:
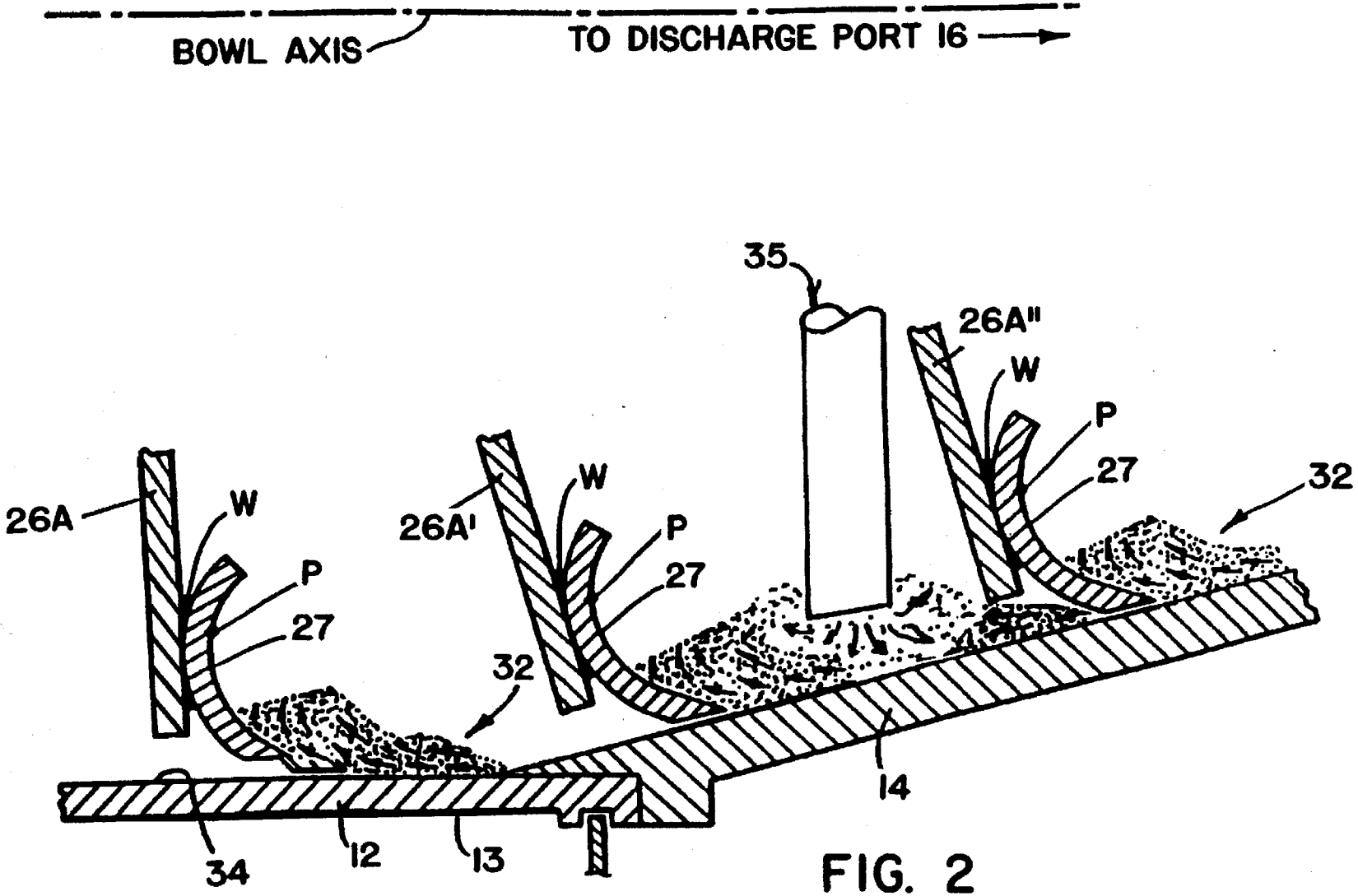
FIG. 2 is a sectional view, taken through the rotational axis of the centrifuge, illustrating a fragment of the bowl and the wash conduit with one embodiment of the helical conveyor blade's distal edge in accordance with the present invention.

In FIG. 2 plow P is mounted by weld W upon the leading surface of flights 26A, 26A' and 26A" adjacent the distal edge of the conveyor blade or flights with the cavity or throat of the profile curve facing discharge port 16. Although a working surface 27 with a smooth throat section is preferred, profiles having one or more sharp angles in the throat may for some solids-liquid feed stocks provide improved performance over flat working surfaces and are comprehended within the scope of the present invention. It also will be obvious to those skilled in the art that the overall dimension as well as the profile shape of working surface 27 may be adjusted to accommodate the dimension of flight 26 and the nature of solids being separated.

Embodiments of the invention shown in FIGS. 3 to 6 employ the same reference numerals used in FIGS. 1 and 2, because the parts are functionally similar.

Figure 3:
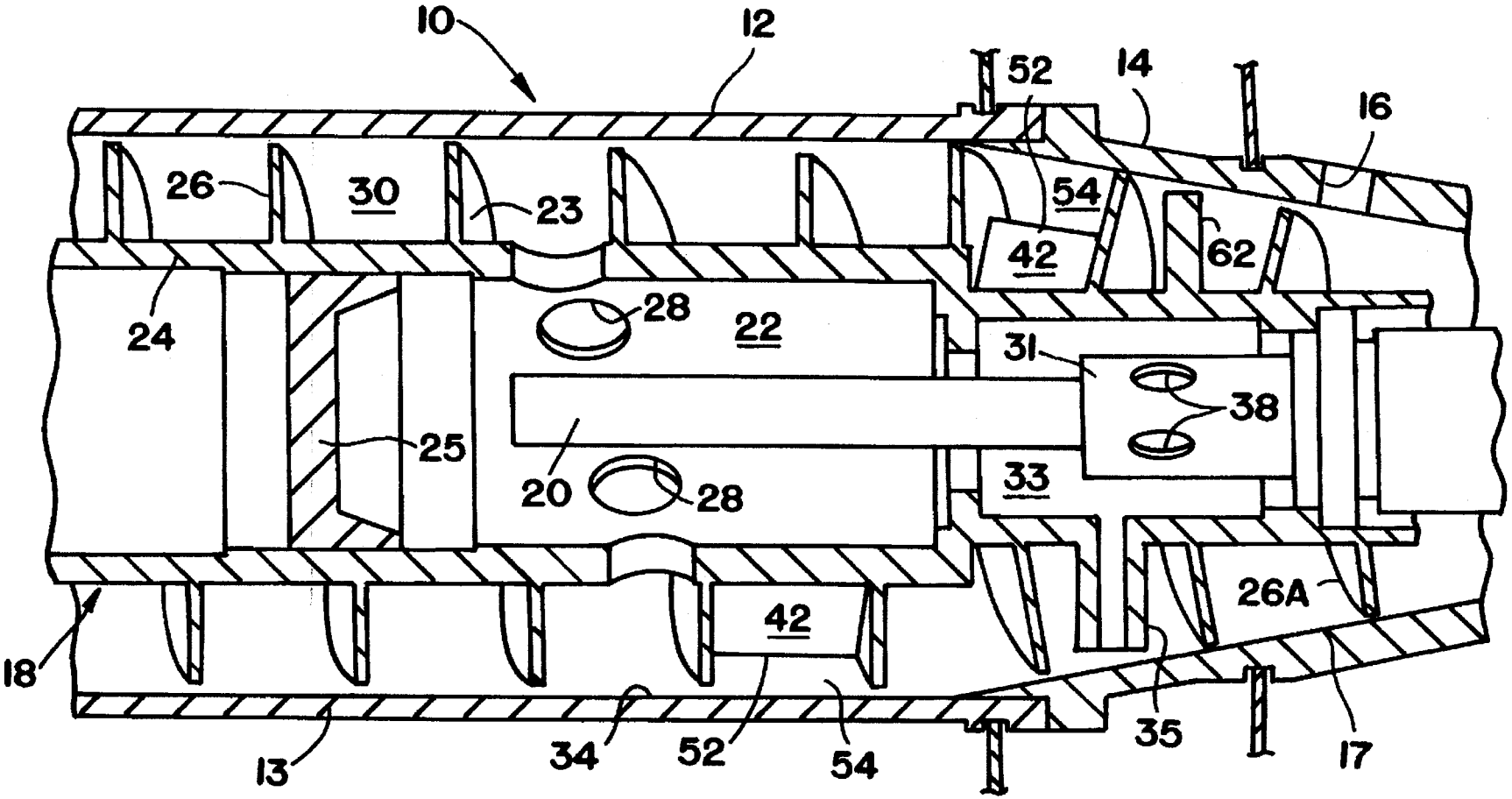
FIG. 3 is a fragmentary, longitudinal sectional view of a centrifuge, taken through the rotational axis of the centrifuge, embodying dip weirs, knife, and wash conduit configurations of the present invention.

Referring to FIG. 3, centrifuge apparatus 10 comprises an axially elongated, centrifuge bowl 12 of circular cross-section. The bowl 12 is adapted for rotation about its longitudinal axis within a housing (not shown). A plurality of liquid discharge openings or liquid overflow ports are, typically, formed in an end wall (not shown) on the cylindrical portion of the bowl 13 and annularly disposed about the rotational axis for discharge of a mixture of mother liquor and washing liquids. A plurality of similarly disposed solids discharge ports or openings 16 are provided adjacent an end wall (not shown) on the tapered section of the bowl 14. While in this embodiment the peripheral wall of bowl 12 is, otherwise, of imperforate tubular construction, a major portion 13 thereof being cylindrical, other embodiments have, optionally, a bowl extension of perforate tubular construction for drying and/or segregated washing of centrifugally separated solids.

The end portion 14 of bowl 12 is tapered or convergent, its inner surface 17 gradually decreasing in diameter towards and beyond the solids discharge ports 16. Solids discharge and liquid discharge ports are at selectively adjustable radial distances from the rotational axis, preferably so that during proper operation the inner surface of the liquid pool will be disposed radially outward of the weir surfaces of the solids discharge ports 16.

Mounted coaxially of bowl 12 in suitable bearings adjacent the ends of bowl 12, is a screw conveyor 18. Bowl 12 is rotated by connection to suitable drive means, such as a motor (not shown). In order to rotate bowl 12 and conveyor 18 at slightly different speeds, the rotation of bowl 12 is transmitted to a gear box having torque control means and thence through a spline shaft within the bowl shaft to conveyor 18 or by other well known means.

In FIG. 3 hub 24 carries outwardly projecting, cylindrically coiled screw flights or helical conveyor blade 26, and outwardly projecting, conically coiled screw flights or helical conveyor blade 26A. Hub 24 also carries one or more outwardly projecting tools or knives 62 for rotation with hub 24 relative to the bowl, with small clearance from the tip of the tool to inner surface 34 of the bowl, thereby cutting, scoring and/or grooving the centrifugally settled solids on the inner surface of the bowl. Hub 24 is further provided with one or more feed passages 28 in order to discharge the feed mixture of mother liquor and solids outwardly from the feed chamber 22 into separation chamber 30 disposed between the outer surface of hub 24 and the inner surface of cylindrical portion 13 of bowl 12. Conveyor flights 26, and 26A are, typically, welded to the outer surface of hub 24, it being understood that conveyor flights 26, are disposed within the cylindrical portion 13 of bowl 12 and conveyor flights 26A are disposed within the tapered portion 14 of bowl 12.

The solids-liquid mixture to be separated is delivered to the interior of the centrifuge through a stationary feed tube 20. The latter projects in axial direction and terminates concentrically of feed chamber 22 partly defined by the interior of hub 24. Again the washing liquid is delivered to the interior of centrifuge 10 through an annulus between stationary feed tube 20 and stationary tube 31. Tube 31 projects in an axial direction and terminates concentrically of a wash chamber 33 partly defined by the interior of hub 24. Wash introduced into wash chamber 33 through wash passages 38 in tube 31 exits radially therefrom through wash tube 35 into a washing zone or zones extending to a drying beach 17 in chamber 30 which is disposed between the outer surface of hub 24 and the inner surface of tapered or convergent end portion 14 of bowl 12.

Conveyor 18, more particularly the outer surfaces of conveyor flights 26, and 26A and of hub 24, defines with the inner surface of bowl 12 a helical chamber extending about the longitudinal axis of the bowl between the liquid overflow ports and the solids discharge ports 16. Dip weirs 42 are shown in the form of flat baffle plates at angles to the plane of the section. Dip weirs 42 are positioned within the bowl 12 to dam, divide, or partition the liquid in the helical chamber, during proper operation, into two or more axially adjacent zones or pools. According to this invention, one or more dip weirs are, advantageously, positioned in the helical chamber between the feed ports 28 and the wash passages 38. A first zone in the helical chamber extends in axial direction from one broad surface of a baffle plate 42 to the solids discharge ports 16. A last zone in the helical chamber extends in axial direction from the opposite broad surface of the same or another baffle plate 42 to the liquid overflow ports. Wash passages 38 communicate with the first washing zone of the helical chamber. Feed ports 28 communicate directly with the last zone of the helical chamber.

It should be understood that feed entering separating chamber 30 within the rapidly rotating bowl 12 is subjected to high centrifugal forces which are usually from about 1,000 to 4,000 times a gravitational force. Centrifugal forces separate the feed mixture of liquid and solids in chamber 30 into an inner annular layer of liquid and an outer layer of centrifugally separated or sedimented solids. Dip weir 42 includes an outer edge 52 which according to the invention is carefully positioned relative to the interface levels between liquid and sedimented solids.

Firstly, the outer edge 52 of dip weir 42 must extend outwardly beyond the inner surface of the annular layer of liquid (pool surface) in order to control flow and mixing of liquid phase materials from one zone to another. Dip weir 42 is, generally, imperforate at least for the radial distance in contact with the centrifugally separated layer of liquid.

Figure 4:
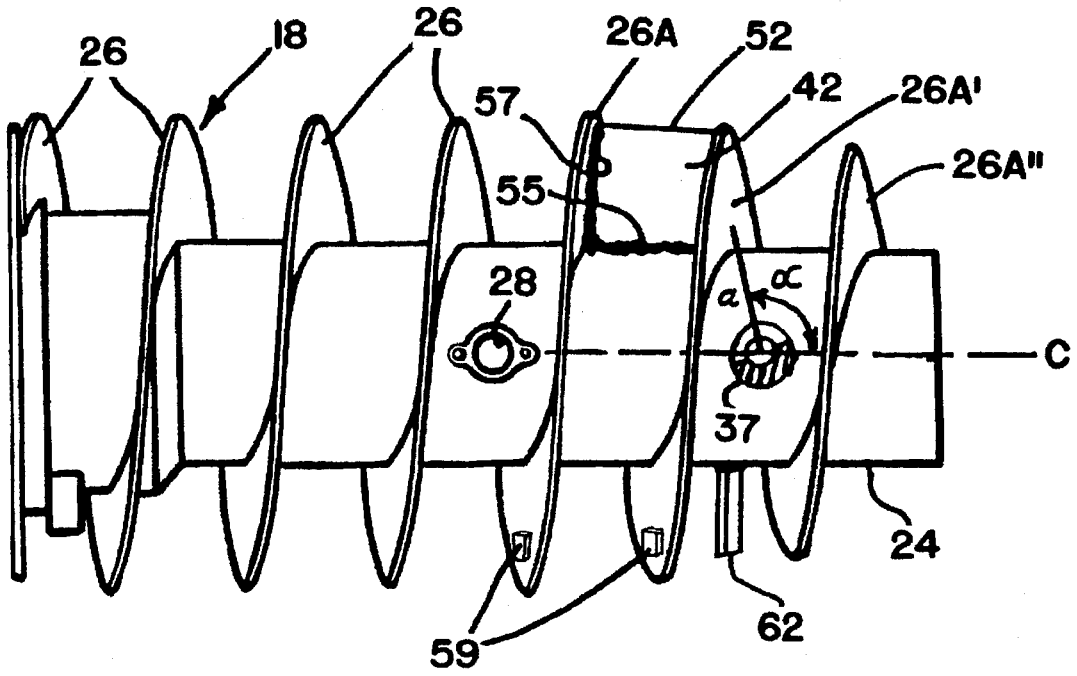
FIG. 4 is an elevational view of a portion of a centrifuge conveyor, embodying dip weirs, knife, and wash conduit configurations of the present invention.
Figure 5:
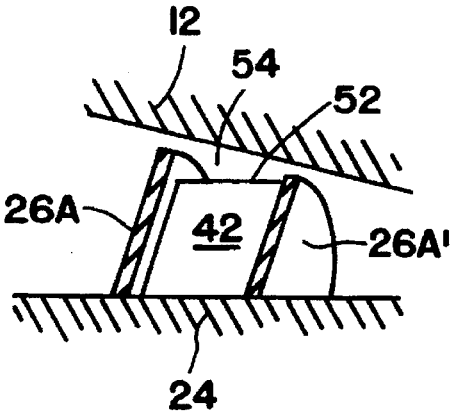
FIG. 5 is a fragmentary, longitudinal sectional view of a centrifuge, embodying dip weir configuration of the present invention.

Secondly, the outer edge 52 of dip weir 42 is positioned inwardly of the inner surface 34 of bowl 12 to define a passageway 54 between adjacent zones for under flow of at least a portion of the sedimented solids in the direction of the drying beach 17 and washing liquid in a generally counter current direction toward the liquid discharge ports. The profile and radial disposition of the outer edge 52 of dip weir 42 determines, together with the outer surfaces of conveyor flights 26, and 26A and inner bowl surface 34, the flow area of passageway 54. For economy of illustration different profiles and their radial dispositions are shown in FIGS. 3, 4 and 5. The flow area of each passageway should be large enough to prevent an excessive accumulation of solid materials and/or washing liquid in the helical chamber, i.e., at least large enough to permit passage of solids in the feed at the rate the solids are centrifugally separated in the separating zone.

The outer edge of any dip weir is, advantageously, positioned and/or adjusted to define a passageway larger at the working surface of the conveyor blade to allow for clearance of the solids on the inner surface of the bowl without an excessive under flow of liquid.

In operation liquid in the first washing zone, where washing liquid enters the helical chamber, contains the lowest concentration of mother liquor and/or the lowest concentration of impurities. In embodiments of the preent invention using two or more dip weirs, concentrations of mother liquor increase from zone to zone with liquid in the last washing zone having the highest concentration of mother liquor.

Wash tubes 35, dip weirs 42, and/or knives 62 are carried by the screw conveyor 18 and are, usually, constructed to form integral parts thereof. In the embodiment of the invention shown in FIGS. 3, 4 and 5, the dip weirs 42 extend in generally axial direction between two adjacent flights of the conveyor blade between the feed ports 28 and wash tube 35. Dip weirs 42 are preferably flat plates disposed between the bowl 12 and one side of hub 24, each with an inner edge 55 welded to the hub 24. Dip weirs 42 also include a pair of side edges 57 welded to respective leading and trailing surfaces of the two adjacent flights of the conveyor blade, such as 26A and 26A', with the weld being continuous along side edges 57, to provide an effective seal against the flow of liquid past at least side edges 57. The welds are, typically, continuous along the side edges 57 and inner edge 55. Any desired orientation of the dip weir which bridges two adjacent flights of the conveyor blade may be used in accordance with the present invention. In typical orientations, the dip weir is substantially normal to the inner surface of the bowl 12, and/or with the two broad surfaces of the dip weir 42 being disposed nearly parallel to a plane extending radially through the longitudinal axis of the bowl.

Optionally, one or more counter weights 59 are secured, as by welding, to the conveyor flights 26A and 26A', in order to maintain the conveyor 18 in proper balance, it being understood that other well known measures may be used for this purpose. Several known baffles constructions are adaptable to use as dip weirs according to the invention. See, for example: U.S. Pat. No. 3,447,742 to John T. Erikson and Birger T. Moller; U.S. Pat. No. 3,934,792 to Robert E. High and Albert J. Samways; and U.S. Pat. No. 4,731,182 to Robert E. High, which are specifically incorporated herein in their entirety by reference.

Referring to FIG. 4, a partial view of a conveyor 18 in elevation normal to the center line of a wash tube 35, the distal end of the wash tube is, advantageously, fitted with deflecting nozzle 37 (shown in cross-section) which directs a flow of washing liquid away from the center line at an angle of deflection $\delta$ (not shown), preferably, in a range from about 0° up to about 90° relative to the center line. In this elevation the central direction of deflected flow is indicated by line a at an angle of rotation $\alpha$ with respect to a line in the direction of the solids discharge port, indicated by broken line c, which line is parallel to the longitudinal axis of the centrifuge. When a deflecting nozzle is used according to the invention, the angle of rotation α is, preferably within a range from about 55° to about 250°, more preferably in a range from about 75° to about 220°. Most preferably, the angle of rotation α is adapted to corporate with other aspects of the invention to achieve the desired reduction of impurities and/or mother liquor on the separated solids. The angle of rotation α is, for example, adapted to corporate with optional forms of the leading surface of the adjacent conveyor blade. Most preferred wash conduit configurations of the present invention have the angles of rotation α which are within in a range from about 75° to about 110° when the working surface of the adjacent conveyor blade has a conventional helical surface, but is within in a range from about 180° to about 220° when the working surface of the adjacent conveyor blade has been modified, as by plow tiles or the like. Several suitable flow deflecting nozzles are commercially available, for example, from Spraying Systems Co, Wheaton, Ill.

In the embodiment of the invention shown in FIGS. 3 and 4, knife 62 is carried by the screw conveyor 18 and is constructed to form integral parts thereof. Knife blade 62 extends outward from hub 24 in generally radial direction between any two adjacent flights of the conveyor blade between the feed ports 28 and solids discharge port 16, with the base of knife 62 welded to the hub 24. Preferably, at least one knife and wash tube 35 are disposed between the same two adjacent flights of the conveyor blade, such as 26A' and 26A".

Figure 6:
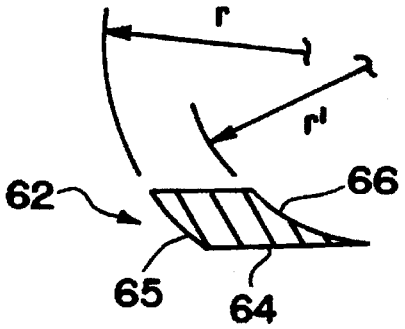
FIG. 6 is a transverse cross-sectional view, taken through a knife blade parallel to the rotational axis of the centrifuge, illustrating one embodiment of knife blades in accordance with the present invention.

Referring to FIG. 6, a transverse cross-sectional view of knife blade 62 normal to the center line thereof, near its distal end, curved surface 65 of knife blade 62 has radius r and leading surface 66 of knife blade 62 has radius r' which is a smaller than radius r. A cutting edge of knife blade 62 is formed at the intersection of the leading surface 66 and surface 64. Knife blade 62 is positioned between and apart from adjacent flights of the conveyor blade with surface 64 and curved surface 65 facing toward the working surface of the conveyor blade, such as 26A', preferably with blade surface 64 in a plane generally parallel with the working surface of the adjacent conveyor blade, more preferably with the cutting edge of knife blade 62 slightly closer than its trailing edge to the working surface of the adjacent conveyor blade. While any position of the knife blade which allows the blade to cut, score, and/or groove sedimented solids in the inner surface of the bowl between two adjacent flights of the conveyor blade may be used, typically the orientation of the knife blade is substantially normal to the inner surface of the bowl 12, with the distal end of the knife blade closely spaced from the inner surface of the bowl, but no closer than the outer edge of the helical conveyor blade.

A critical element of the present invention contributing to more effective washing of crystals with fresh solvent on the centrifuge, Applicants' believe, is that each independent wash tube is free from orifices and/or any plurality of series of orifices spaced inwardly from the distal end of the wash conduit. Thus the full potential force of the liquid head in each independent wash tube is available at its distal end. Washing liquid from its distal end is, therefore, more effective to penetrate sedimented solids, tumbling and suspending them in washing liquid.

Flights, backing tile and/or plows, if used, may be constructed of dissimilar materials to achieve improved strength, durability and manufacturing efficiency at satisfactory cost. For example, U.S. Pat. No. 3,764,062 to Frank Charles Brautigam, U.S. Pat. No. 4,328,925 to Leonard Shapiro, and U.S. Pat. No. 4,826,608 to Michael Kopper which patents are specifically incorporated herein in their entirety by reference, are directed to composite constructions forming working surfaces which may, advantageously, be of materials different from the flight on which they are mounted.

Screw conveyors, if desired, may be constructed with apertures in their flights, backing tile or plows, and/or with discontinuous flights. For example, U.S. Pat. No. 3,971,509 to Frank Birger Johnsen, and U.S. Pat. No. 5,261,869 to John W. Caldwell an inventor of the present invention, which patents are specifically incorporate herein in their entirety by reference, are directed to constructions whereby the axial movement of at least some of the transported solid matter is temporarily stopped when that matter passes through an aperture and/or discontinuity.

In one embodiment of the present invention, a centrifuge for separating a solid phase from a liquid phase includes a conveyor comprising at least one, preferably two continuous helices having at least one aperture in each of the helices within the trunco-conical portion of the bowl, the apertures extending inwardly from the outer periphery of the respective helices and located in a common helicoid surface, and one or more wash tubes disposed according to the present invention in cooperation with the apertures. At the apertures axial movement of at least some of the wedge of sedimented solid matter is temporarily stopped and/or falls backward when that matter passes through the aperture. At or near the point which matter passes through the aperture, washing liquid from distal end of the wash tube is, advantageously, directed into the sedimented solids, tumbling and suspending them in washing liquid.

Particularly useful embodiments of the present invention comprise a solid-bowl centrifuge apparatus having a beach section with an angle in a range of up to about 25 degrees, preferably a beach angle in a range from about 5 degrees to about 20 degrees. The centrifuge bowl is adapted to operate at speeds in a range upward from about 1000 rpm, preferably in a range from about 1500 rpm to about 4000 rpm. The leading surface of at least one helically and coaxially mounted conveyor blade has a curvilinear shape adapted to, in use, plow over sedimented solids in the beach section. Washing liquid is introduced into the separation chamber of the centrifuge bowl near a point along its axis where cake was conveyed out of the liquid pool and onto the drying beach. To effectively deliver washing liquid into sedimented solids, tumbling and suspending them in washing liquid, the conveyor is, according to this invention, provided with one or more radial wash conduits located between conveyor flights at the dry beach section of the bowl. The distal end of the wash conduit is positioned in close proximity to the inner surface of the bowl. Advantageously, the distal end is equipped with a nozzle positioned to direct washing liquid into solids along the leading surface of conveyor blade. Nozzle tip distance from bowl wall is, typically, in a range upward from about ½ cm to about 3 cm.

Improved screw conveyor centrifugal apparatus for separation of solids-liquid mixtures and internal washing of solids, according to this invention, is particularly useful for separation and washing of solids-liquid feed containing up to about 60 weight percent solids, preferably from about 15 to about 55 weight percent solids. Any suitable wash ratio can be used. Typically, wash ratio are in a range downward from about 5 pounds of washing liquid per pound of solids, preferably in a range downward from about 2 pounds of washing liquid per pound of solids, and more preferably in a range from about 0.2 to about 2 pounds of washing liquid per pound of solids.

In a preferred embodiment, Applicants' invention is a process for the continuous separation of solids-liquid mixtures and the internal washing of solids, the process comprising:

(A) Providing a separation apparatus which comprises; a centrifuge with an elongated bowl having an inner bowl surface including liquid overflow ports, a cylindrical portion adapted to receive the solids-liquid mixtures and a trunco-conical portion having a discharge port adapted to discharge of solids separated from the mixture, the bowl being mounted for rotation about its longitudinal axis, and a conveying means including at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the inner bowl surface and means for rotating the bowl and the conveyor blade at a speed differential to contact the distal edge of the conveyor blade with the solids upon separation and propel separated solids toward the solids discharge port, and the conveying means having one or more wash conduits with a distal end positioned in close proximity to the inner surface of the bowl between flights of the conveyor blade, for the distal end of the conduit to deliver washing liquid into centrifugally sedimented solids on the inner bowl surface at least within the trunco-conical portion of the bowl;

(B) Feeding the solids-liquid mixture into the elongated bowl of the centrifugal while continuous rotating the bowl and the conveying means at a speed differential to separate the solids-liquid mixture into separate components by centrifugal action and propel centrifugally sedimented solids toward the solids discharge port; and (C) Delivering at least one washing liquid into the centrifugally sedimented solids through one or more of the wash conduits within the trunco-conical portion of the bowl.

Processes according to the invention are particularly suitable for separation of solid crystalline chemical compounds from liquids under process conditions which do not degrade quality, such as chemical purity of a desired crystalline product. For example, aromatic acids and anhydrides which can be formed from a corresponding methyl substituted aromatic compound by liquid-phase oxidation with an oxygen-containing gas in the presence of an oxidation catalyst at elevated pressures and temperatures are, advantageously, recovered from mother liquor and or washing liquid in processes according to this invention. Carboxyl groups in preferred aromatic acids are either attached directly to an independent benzene ring or to benzene rings of a condensed ring system such as naphthalene, in which two benzene rings have two carbon atoms in common or anthracene in which three rings are similarly connected so that the rings are not independent.

Suitable aromatic acids for recovery according to this invention include any dicarboxylic acid, for example terephthalic acid, naphthalene dicarboxylic acid, 4,4'-oxybis (benzoic acid), 5-tert-butyl-1,3-benzene dicarboxylic acid, or anhydride such as trimellitic anhydride and the like. Applicants' process is particularly useful for terephthalic acid, isophthalic acid or 2,6-naphthalene dicarboxylic acid.

Advantageously washing liquids consisting of a $C_2$ to $C_6$ monocarboxylic acid, water, or a mixture thereof, are used to recover a product containing the desired aromatic acid having an improved purity.

The following examples will serve to illustrate certain specific embodiments of the herein disclosed invention. These examples should not, however, be construed as limiting the scope of the novel invention, as there are many variations which may be made thereon without departing from the spirit of the disclosed invention, as those of skill in the art will recognize.

EXAMPLES OF THE INVENTION

General

Solids-liquid separations in the following examples were carried out using a 14-inch solid-bowl centrifuge apparatus having a 10-degree beach angle. The centrifuge was operated at speeds up to about 3300 rpm.

The solids-liquid feed used in these examples contained 35 to 45 weight percent solids with a specific gravity of 1.5 in water. Average particle size of the solids was varied from about 75 to 150 microns. Sodium chloride was used as a "tracer" in the feed slurry to simplify analysis of performance.

Wash liquid was introduced into the separation chamber within the tapered portion of the bowl near a point along the axis of the centrifuge where cake was conveyed out of the liquid pool and onto the drying beach. Testing included wash ratios up to about 2 pounds of wash per pound of feed solids.

Example 1

In this example, a series of runs was carried out according to this invention with a wash conduit located between conveyor flights at the dry beach section of the bowl. The distal end of the wash conduit was equipped with a deflecting nozzle positioned to have an angle of rotation $\alpha$ of about 189°. Plow tiles were fitted to the leading surface of the conveyor flights. The nozzle was spaced ¼ inch from the bowl wall. At a wash ratio of 1 pound of wash per pound of feed solids, residual impurities in the discharged cake were reduced by 82 percent based on residual impurities in unwashed cake.

Example 2

In this example, another series of runs was carried out as in Example 1, except no plow tiles were used on the conveyor flights and the radial wash conduit was equipped with a different deflecting spray nozzle spaced 3/16 inch from the bowl wall and positioned to have an angle of rotation $\alpha$ of about 90°. At a wash ratio of 0.5 pounds of wash per pound of feed solids, residual impurities in the discharged cake were reduced by 63 percent based on residual impurities in unwashed cake.

Example 3

In this example, another series of runs was carried out as in Example 2, except the conveyor was fitted with fourteen solids-cutting knife blades disposed radially around the hub. These knife blades had a diamond-shaped transverse cross-section, substantially as shown in FIG. 6, which measured about 5/16 inch wide to cut swath through the sedimented solids on the inner surface of the bowl. Most of the knife blades were located along the hub within the trunco-conical portion of the bowl and disposed at various spacing from the leading surface of the conveyor blade. At a wash ratio of 0.5 pounds of wash per pound of feed solids, residual impurities in the discharged cake were reduced by 63 percent based on residual impurities in unwashed cake.

Example 4

In this example, another series of runs was carried out as in Example 3, except the conveyor was fitted with two longitudinal weirs disposed between adjacent conveyor flights and adapted to dip into the surface of the liquid pool within the trunco-conical portion of the bowl. At a wash ratio of 0.5 pounds of wash per pound of feed solids, residual impurities in the discharged cake were reduced by 63 percent based on residual impurities in unwashed cake.

Example 5

In this example, another series of runs was carried out as in Example 3 with one identical spray-nozzle for washing liquid installed on the conveyor hub, but with no additional radial conduit. The nozzle was spaced 1.1 inches from the bowl wall. At a wash ratio of 0.5 pounds of wash per pound of feed solids, residual impurities in the discharged cake were reduced by 53 percent based on residual impurities in unwashed cake.

Example 6

In this example, another series of runs was carried out as in Example 5, except the conveyor was also fitted with two longitudinal weirs as in Example 4. At a wash ratio of 0.5 pounds of wash per pound of feed solids, residual impurities in the discharged cake were reduced by 63 percent based on residual impurities in unwashed cake.

Example 7

In this example, another series of runs was carried out as in Example 3, with one identical spray-nozzle for washing liquid installed on the conveyor hub with a shorter radial conduit to position the nozzle ½ inch from the bowl wall. At a wash ratio of 0.5 pounds of wash per pound of feed solids, residual impurities in the discharged cake were reduced by 63 percent based on residual impurities in unwashed cake.

Example 8

In this example, another series of runs was carried out as in Example 1, except the conveyor was fitted with ten solids-cutting knife blades disposed, as in Example 3, radially around the hub at various spacing from the leading surface of the conveyor blade. Also as in Example 3, these knife blades had a transverse cross-section substantially as shown in FIG. 6. Most of the knife blades were located along the hub within the trunco-conical portion of the bowl. The knife blades scored, cut and grooved the sedimented solids on the inner surface of the bowl. At a wash ratio of 0.5 pounds of wash per pound of feed solids, residual impurities in the discharged cake were reduced by 75 percent based on residual impurities in unwashed cake. At a wash ratio of 1 pound of wash per pound of feed solids, residual impurities in the discharged cake were reduced by 84 percent based on residual impurities in unwashed cake.

Comparative Example A

In this example, a series of comparable runs was carried out as in Example 2, but with one identical spray-nozzle for washing liquid installed on the conveyor hub with no additional radial conduit. The nozzle was spaced 1.1 inches from the bowl wall. At a wash ratio of 0.5 pounds of wash per pound of feed solids, residual impurities in the discharged cake were reduced by only 40 percent based on residual impurities in unwashed cake.

Comparative Example B

In this example, the liquid-solids feed to the centrifuge is diluted with 0.5 pounds of washing liquid per pound of solids in the liquid-solids feed. Separation of the solids from the mixture of mother liquor and diluent liquid is found by a material balance calculation performed by assuming that the mother liquor is uniformly diluted without dissolving solids. Residual impurities in the cake are reduced by only 25 percent based on residual impurities in cake for the undiluted case.

That which is claimed is:

1. A centrifuge apparatus for continuous separation of solids-liquid mixtures into separate components and internal washing of separated solids comprising an elongated bowl having an inner bowl surface including liquid overflow ports, a cylindrical portion adapted to receive the solids-liquid mixtures and a trunco-conical portion having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the bowl surface and means for rotating the bowl and the conveyer blade at a speed differential to contact the distal edge of the conveyor blade with the solids upon separation and propel separated solids toward the solids discharge port, the improvement which comprises providing the conveying means with one or more wash conduits each of which has a center line located along a radius perpendicular to the longitudinal axis of the centrifuge with a distal end positioned in close proximity to the inner surface of the bowl between flights of the conveyer blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge.

2. The centrifuge apparatus according to claim 1 wherein the deflecting nozzle means is adapted to direct a flow of washing liquid away from the center line at angles of up to about 90° thereto.

3. A process for continuous separation of solids-liquid mixtures by centrifugal action and internal washing of separated solids, the process comprising:

(A) Providing a separation apparatus which comprises;

a centrifuge with an elongated bowl having an inner bowl surface including liquid overflow ports, a cylindrical portion adapted to receive the solids-liquid mixtures and a trunco-conical portion having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the conveyer blade in a closely spaced, sweeping relationship to the inner bowl surface and means for rotating the bowl and the conveyer blade at a speed differential to contact the distal edge of the conveyer blade with the solids upon separation and propel separated solids toward the solids discharge port, and the conveying means having one or more wash conduits each of which has a center line located along a radius perpendicular to the longitudinal axis of the centrifuge, with a distal end positioned in close proximity to the inner surface of the bowl between flights of the conveyor blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge;

(B) Feeding the solids-liquid mixture into the elongated bowl of the centrifugal while continuously rotating the bowl and the conveying means at a speed differential to separate the solids-liquid mixture into separate components by centrifugal action and propel centrifugally sedimented solids toward the solids discharge port; and (C) Delivering at least one washing liquid into the centrifugally sedimented solids through one or more of the wash conduits within the trunco-conical portion of the bowl.

4. The process according to claim 3 wherein the solids-liquid mixture comprises an aromatic acid or anhydride formed from a corresponding substituted aromatic compound by liquid-phase oxidation with an oxygen-containing gas in the presence of an oxidation catalyst at elevated pressures and temperatures, and wherein the washing liquid comprises a member selected from the group consisting of a $C_2$ to $C_6$ monocarboxylic acid, water, or a mixture thereof, and wherein the deflecting nozzle means is adapted to direct a flow of washing liquid away from the center line at angles of up to about 90° thereto, and wherein the flights of the conveyor blade close to the distal end of the wash conduit are between where the bowl receives the solids-liquid mixtures and the discharge port for solids.

5. The process according to claim 4 wherein the solids-liquid mixture comprises an aromatic acid selected from the group consisting of trimellitic anhydride, terephthalic acid, isophthalic acid, naphthalene dicarboxylic acid, 4,4'-oxybis (benzoic acid), and 5-tert-butyl-1,3-benzene dicarboxylic acid.

6. A centrifuge apparatus for continuous separation of solids-liquid mixtures into separate components and internal washing of separated solids comprising an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyor blade having a leading surface facing in the direction of the discharge port for solids and a distal edge, the conveyor blade bring helically and coaxially mounted within the bowl to form a series of flights through the length of the bowl surface with the distal edge of the flights of the conveyor blade in a closely spaced, sweeping relationship to the inner bowl surface and means for rotating the bowl and the conveyor blade at a speed differential to contact the distal edge of the conveyer blade with the solids upon separation and propel separated solids toward the solids discharge port, the inner bowl surface and the conveyer blade defining a helical chamber extending between opposite ends of the bowl, the improvement which comprises providing the conveying means with one or more cutting tools each of which has a distal end positioned in close proximity to the inner surface of the bowl between flights of the conveyer blade, adapted to score grooves into centrifugally sedimented solids on the inner bowl surface at least within the trunco-cortical portion of the bowl, and comprises providing the conveying means with one or more wash conduits each of which has a center line located along a radius perpendicular to the longitudinal axis of the centrifuge, with a distal end positioned in close proximity to the inner surface of the bowl between flights of the conveyer blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge.

7. The centrifuge apparatus according to claim 6 wherein the conveying means is, within the bowl, further provided with one or more dip weirs with broad surfaces dividing the helical chamber into axially adjacent zones including at least a first zone in the helical chamber which extends in axial direction from a broad surface of one dip weir to the solids discharge port and a last zone in the helical chamber which extends in axial direction from the opposite broad surface of the same or another dip weir to the liquid overflow ports, each dip weir having an outer edge spaced from the inner bowl surface to provide a suitable passageway for transfer of liquids and solids between adjacent zones.

8. The centrifuge apparatus according to claim 6 wherein the leading surface of at least a portion of one conveyor flight is provided with an arcuate surface portion adjacent to the distal edge thereof of defined concavity in the leading surface and shape adapted to contact the centrifugally sedimented solids and tumbling them in washing liquid.

9. The centrifuge apparatus according to claim 6 wherein the deflecting nozzle means is adapted to direct a flow of washing liquid away from the center line at angles of up to about 90° thereto.

10. A process for continuous separation of solids-liquid mixtures by centrifugal action and internal washing of separated solids, the process comprising:

(A) Providing a separation apparatus which comprises;

a centrifuge with an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the inner bowl surface, the conveyer blade and the iralet surface of the bowl and the conveyer blade at a speed differential to contact the distal edge of the conveyer blade with the solids upon separation and propel separated solids toward the solids discharge port, the inner bowl surface and the conveyer blade defining a helical chamber extending between opposite ends of the bowl, the conveying means provided with one or more cutting tools each of which has a distal end positioned near the inner surface of the bowl between flights of the conveyer blade, adapted to score grooves into centrifugally sedimented solids on the inner bowl surface at least within the trunco-conical portion of the bowl, and the conveying means provided with one or more wash conduits each of which has a center line located along a radius perpendicular to the longitudinal axis of the centrifuge, with a distal end positioned in close proximity to the inner surface of the bowl between flights of the conveyer blade, said one or more wash conduits each provided with a deflecting nozzle means for directing a flow of washing liquid away form the center line of the conduit deliver washing liquid into centrifugally sedimented solids on the inner bowl surface at least within the trunco-conical portion of the bowl, each said deflecting nozzle means being disposed at an angle $\alpha$ of rotation on the center line of a respective conduit of from about 55° to about 250° with respect to a line in the direction of the solids discharge port parallel to the longitudinal axis to the centrifuge;

(B) Feeding the solids-liquid mixture into the elongated bowl of the centrifugal while continuously rotating the bowl and the conveying means at a speed differential to separate the solids-liquid mixture into separate components by centrifugal action and propel centrifugally sedimented solids toward the solids discharge port; and (C) Delivering at least one washing liquid into the centrifugally sedimented solids through one or more of the wash conduits within the trunco-conical portion of the bowl.

11. The process according to claim 10 wherein the solids-liquid mixture comprises an aromatic acid or anhydride formed from a corresponding substituted aromatic compound by liquid-phase oxidation with an oxygen-containing gas in the presence of an oxidation catalyst at elevated pressures and temperatures, and wherein the washing liquid comprises a member selected from the group consisting of a $C_2$ to $C_6$ monocarboxylic acid, water, or a mixture thereof.

12. A centrifuge apparatus for continuous separation of solids-liquid mixtures into separate components and internal washing of separated solids comprising an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the inner bowl surface, the conveyer blade and the inner surface of the bowl defining a helical chamber and means for rotating the bowl and the conveyer blade at a speed differential to contact the distal edge of the conveyer blade with the solids upon separation and propel separated solids toward the solids discharge port, the inner bowl surface and the conveyer blade defining a helical chamber extending between opposite ends of the bowl, the improvement which comprises providing the conveying means within the bowl with one or more dip weirs with broad surfaces dividing the helical chamber into axially adjacent zones including at least a first zone in the helical chamber which extends in axial direction from a broad surface of one dip weir to the solids discharge port and a last zone in the helical chamber which extends in axial direction from the opposite broad surface of the same or another dip weir to the liquid overflow ports, each dip weir having an outer edge spaced from the inner bowl surface to provide a suitable passageway for transfer of liquids and solids between adjacent zones, and comprises providing the conveying means with one or more wash conduits each of which has a center line located along a radius perpendicular to the longitudinal axis of the centrifuge, with a distal end positioned in close proximity to the inner surface of the bowl between flights of the conveyer blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge.

13. The centrifuge apparatus according to claim 12 wherein at least one of the dip weirs is a flat plate extending in generally axial direction between two adjacent flights of the conveyor blade between where the bowl receives the solids-liquid mixtures and the discharge port for solids, and with the broad surfaces of the dip weir being disposed generally parallel to a plane extending radially through the longitudinal axis of the bowl.

14. The centrifuge apparatus according to claim 12 wherein the leading surface of at least a portion of one conveyer flight is provided with an axcuate surface portion adjacent to the distal edge thereof of defined concavity in the leading surface and shape adapted to contact the centrifugally sedimented solids and tumbling them in washing liquid.

15. The centrifuge apparatus according to claim 12 wherein the deflecting nozzle means is adapted to direct a flow of washing liquid away from the center line at angles of up to about 90° thereto.

16. A process for continuous separation of solids-liquid mixtures by centrifugal action and internal washing of separated solids, the process comprising:

(A) Providing a separation apparatus which comprises;

a centrifuge with an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the inner bowl surface and means for rotating the bowl and the conveyer blade at a speed differential to contact the distal edge of the conveyer blade with the solids upon separation and propel separated solids toward the solids discharge port, the inner bowl surface and the conveyer blade defining a helical chamber extending between opposite ends of the bowl, the conveying means within the bowl having one or more dip weirs with broad surfaces dividing the helical chamber into axially adjacent zones including at least a first washing zone in the helical chamber which extends in axial direction from a broad surface of one dip weir to the solids discharge port and a last washing and separating zone in the helical chamber which extends in axial direction from the opposite broad surface of the same or another dip weir to the liquid overflow ports, each dip weir having an outer edge spaced from the inner bowl surface to provide a suitable passageway for transfer of liquids and solids between adjacent zones, and the conveying means provided with one or more wash conduits each of which has a center line located along a radius perpendicular to the longitudinal axis of the centrifuge, with a distal end positioned in close proximity to the inner surface of the bowl between flights of the conveyer blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge;

(B) Feeding the solids-liquid mixture into the elongated bowl of the centrifugal while continuously rotating the bowl and the conveying means at a speed differential to separate the solids-liquid mixture into separate components by centrifugal action and propel centrifugally sedimented solids toward the solids discharge port; and (C) Delivering at least one washing liquid into the centrifugally sedimented solids through one or more of the wash conduits within the trunco-conical portion of the bowl.

17. The process according to claim 16 wherein the solids-liquid mixture comprises an aromatic acid or arthydride formed from a corresponding substituted aromatic compound by liquid-phase oxidation with an oxygen-containing gas in the presence of an oxidation catalyst at elevated pressures and temperatures, and wherein the washing liquid comprises a member selected from the group consisting of a $C_2$ to $C_6$ monocarboxylic acid, water, or a mixture thereof.

18. A centrifuge apparatus for continuous separation of solids-liquid mixtures into separate components and internal washing of separated solids comprising an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the inner bowl surface and means for rotating the bowl and the conveyer blade at a speed differential to contact the distal edge of the conveyer blade with the solids upon separation and propel separated solids toward the solids discharge port, the inner bowl surface and the conveyer blade defining a helical chamber extending between opposite ends of the bowl, the improvement which comprises providing the leading surface of at least a portion of one of the conveyer flights with an arcuate surface portion adjacent to the distal edge thereof of defined concavity in the leading surface and shape adapted to contact the centrifugally sedimented solids and tumbling them in washing liquid, and comprises providing the conveying means with one or more wash conduits each of which has a center line located along a radius perpendicular to the longitudinal axis of the centrifuge, with a distal end positioned in close proximity to the inner surface of the bowl between flights of the conveyer blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle $\alpha$ of rotation on the center line of a respective wash conduit of from about 55° to about 250° with respect to a line in the direction of the solids discharge port parallel to the longitudinal axis of the centrifuge.

19. The centrifuge apparatus according to claim 18 wherein the arcuate surface portion extends along the leading surface within the trunco-conical portion of the bowl and from the trunco-conical portion of the bowl at least partially into the cylindrical portion of the bowl.

20. The centrifuge apparatus according to claim 18 wherein the arcuate surface portion is provided in part by appropriate curvature of the conveyor blade and in part by an add-on member of shape suitable to provide the arcuate surface.

21. The centrifuge apparatus according to claim 18 wherein the deflecting nozzle means is adapted to direct a flow of washing liquid away from the center line at angles of up to about 90° thereto.

22. The centrifuge apparatus according to claim 21 wherein the conveying means is provided with plurality of knives having a distal end which are positioned near the inner surface of the bowl between flights of the conveyor blade, the distal end of each knife adapted to score grooves into centrifugally sedimented solids on the inner bowl surface at least within the trunco-conical portion of the bowl.

23. The centrifuge apparatus according to claim 21 wherein the conveying means is, within the bowl, further provided with one or more dip weirs with broad surfaces dividing the helical chamber into axially adjacent zones including at least a first zone in the helical chamber which extends in axial direction from a broad surface of one dip weir to the solids discharge port and a last zone in the helical chamber which extends in axial direction from the opposite broad surface of the same or another dip weir to the liquid overflow ports, each dip weir having an outer edge spaced from the inner bowl surface to provide a suitable passageway for transfer of liquids and solids between adjacent zones.

24. A process for continuous separation of solids-liquid mixtures by centrifugal action and internal washing of separated solids, the process comprising:

(A) Providing a separation apparatus which comprises; a centrifuge with an elongated bowl having an inner bowl surface including liquid overflow ports, a cylindrical portion adapted to receive the solids-liquid mixtures and a trunco-conical portion adapted to receive washing liquids, the trunco-conical portion of the bowl having a discharge port adapted to discharge of solids separated from the mixture, the bowl being mounted for rotation about its longitudinal axis, and a conveying means including at least one conveyer blade having a leading surface facing in the direction of the discharge port for solids and a distal edge, the conveyer blade being helically and coaxially mounted within the bowl to form a series of flights through the length of the bowl surface with the distal edge of the flights of the conveyer blade in a closely spaced, sweeping relationship to the inner bowl surface and means for rotating the bowl and the conveyer blade at a speed differential to contact the distal edge of the conveyer blade with the solids upon separation and propel separated solids toward the solids discharge port, the inner bowl surface and the conveyer blade defining a helical chamber extending between opposite ends of the bowl, the leading surface of at least a portion of at least one of the conveyer flights provided with an arcuate surface portion adjacent to the distal edge thereof of defined concavity in the leading surface and shape adapted to contact the centrifugally sedimented solids and tumbling them in washing liquid, and the conveying means provided with one or more wash conduits each of which has a center line located along a radius perpendicular to the longitudinal axis of the centrifuge, with a distal end positioned in close proximity to file inner surface of the bowl between flights of the conveyor blade, said one or more wash conduits each provided with a deflecting nozzle means for directing a flow of washing liquid away from the center line of the conduit to deliver washing liquid into centrifugally sedimented solids on the inner bowl surface at least within the trunco-conical portion of the bowl, each said deflecting nozzle means being disposed at an angle of $\alpha$ of rotation on the center line of a respective wash conduit of from about 55° to about 250° with respect to a line in the direction of the solids discharge port parallel to the longitudinal axis of the centrifuge;

(B) Feeding the solids-liquid mixture into the elongated bowl of the centrifugal while continuously rotating the bowl and the conveying means at a speed differential to separate the solids-liquid mixture into separate components by centrifugal action and propel centrifugally sedimented solids toward the solids discharge port; and (C) Delivering at least one washing liquid into the centrifugally sedimented solids through one or more of the wash conduits within the trunco-conical portion of the bowl.

25. The process according to claim 24 wherein the solids-liquid mixture comprises an aromatic acid or anhydride formed from a corresponding substituted aromatic compound by liquid-phase oxidation with an oxygen-containing gas in the presence of an oxidation catalyst at elevated pressures and temperatures, and wherein the washing liquid comprises a member selected from the group consisting of a $C_2$ to $C_6$ monocarboxylic acid, water, or a mixture thereof.

* * * * *

UNITED STATES PATENT AND TRADEMARK OFFICE
CERTIFICATE OF CORRECTION

PATENT NO.: 5,653,673

DATED: August 5, 1997

INVENTOR(S): Vikram J. Desai, John W. Caldwell, Alan G. Letki

It is certified that error appears in the above-identified patent and that said Letters Patent is hereby corrected as shown below:

Patent reads:

| Col. | Line | |
|---|---|---|
| 2 | 32 | "mother liquor mounting"<br>should read --mother liquor amounting-- |
| 12 | 11 | "specifically incorporate herein"<br>should read --specifically incorporated herein-- |
| 17 | 63 | "blade bring helically"<br>should read --blade being helically-- |
| 18 | 12 | "trunco-cortical portion of the bowl,"<br>should read --trunco-conical portion of the bowl,-- |
| 19 | 3-4 | "conveyer blade and the iralet"<br>should read --conveyer blade and the inner-- |
| 19 | 25 | "form the center line of the conduit deliver"<br>should read<br>--from the center line of the conduit to deliver-- |
| 19 | 30 | "center line of a respective conduit"<br>should read<br>--center line of a respective wash conduit-- |

UNITED STATES PATENT AND TRADEMARK OFFICE
CERTIFICATE OF CORRECTION

PATENT NO.: 5,653,673

DATED: August 5, 1997

INVENTOR(S): Vikram J. Desai, John W. Caldwell, Alan G. Letki

It is certified that error appears in the above-identified patent and that said Letters Patent is hereby corrected as shown below:

Patent reads:

| Col. | Line | |
|---|---|---|
| 20 | 46 | "axcuate surface portion" should read --arcuate surface portion-- |
| 21 | 56 | "arthydride" should read --anhydride-- |
| 24 | 6 | "proximity to file inner surface of the bowl" should read --proximity to the inner surface of the bowl-- |

Signed and Sealed this

Sixteenth Day of March, 1999

*Attest:*

Q. TODD DICKINSON

*Attesting Officer*

*Acting Commissioner of Patents and Trademarks*